US006048421A

United States Patent [19]

White

[11] Patent Number: 6,048,421

[45] Date of Patent: Apr. 11, 2000

[54] AUTOMATIC LID FORMING MACHINE

[75] Inventor: Michael A. White, Kennewick, Wash.

[73] Assignee: Delaware Capital Formation, Inc., Wilmington, Del.

[21] Appl. No.: 09/087,446

[22] Filed: May 29, 1998

[51] Int. Cl.[7] ..... B65B 7/20

[52] U.S. Cl. ..... 156/69; 53/306; 53/488; 156/478; 156/566

[58] Field of Search ..... 156/69, 478, 566, 156/578; 53/287, 306, 488

[56] References Cited

U.S. PATENT DOCUMENTS

| | | | |
|---|---|---|---|
| 3,501,895 | 3/1970 | Geyer | 53/287 |
| 3,634,995 | 1/1972 | Curtis | 53/306 |
| 3,810,345 | 5/1974 | Lemmond | 53/306 |
| 3,896,607 | 7/1975 | Royal | 53/287 |
| 3,913,300 | 10/1975 | Benzing | 53/306 |
| 4,117,646 | 10/1978 | James | 53/488 |

*Primary Examiner*—Daniel Stemmer
*Attorney, Agent, or Firm*—Mark D. Miller

[57] ABSTRACT

An improved vertically oriented machine which is capable of forming and adhering lids to open ended fiberboard containers. The improved machine includes a lower horizontal conveyor for bringing open-ended containers into the machine; a vertical lifting section including a novel elevation mechanism for lifting the containers; a lid feeding mechanism located along the path of the vertical lifting section for providing the lids to be placed onto the containers; a set of adhesive applicators; a series of adjustable spring-mounted compression shoes including a novel frictional lid holding member located along the path of the vertical lifting section above the lid feeding mechanism for deforming the sides of the lids around the container; and an ejection mechanism for removing the lidded container from the machine.

9 Claims, 11 Drawing Sheets

AUTOMATIC LID FORMING MACHINE

BACKGROUND OF THE INVENTION

1. Field of the Invention

The present invention relates to container forming machines, and in particular to a new and improved method and apparatus for forming and attaching lids to fiberboard containers.

2. Description of the Prior Art

In the packaging industry, numerous fiberboard containers and designs have been developed over the years. Such containers are typically constructed of a corrugated material and are used to ship and store a wide variety of products such as fresh fruits and vegetables, canned and bottled goods, meat, and the like. The fiberboard materials may be single face corrugated, single wall (double-faced) corrugated, double wall corrugated, triple wall corrugated, etc. Containers may also be made of other paperboard products including, without limitation, container board, boxboard, linerboard, and cardboard.

Of the numerous types of fiberboard containers that have been developed, many employ lids that are separate from the main box of the container. A "box" (or "case") is a large, usually rectangular container made out of fiberboard or paperboard and designed to hold a given number (e.g. 12 or 24) of smaller units such as cartons, bottles, cans, or produce pieces. A "tray" is a term used to describe a variety of different containers, but which is typically used to describe a style of box which uses a separate lid. Tray boxes may also refer to containers designed to hold a certain weight or volume of product (e.g. 35 pounds of grapes, 60 pounds of beef, etc.).

There are numerous machines in the industry which are used to form open ended (i.e. lidless) tray boxes. Such machines are typically included as part of a larger production line as follows: a first machine forms the empty tray box itself, a second machine fills the box with its contents, a third machine forms or provides a lid for the box, and a fourth machine attaches the lid to the box.

Existing lid forming and attaching machines are slow in operation and mechanically cumbersome. Some existing machines lift the tray box vertically up to the lid on a table which moves up and down from a lower to an upper position. The operation of such machines is extremely slow since the next box in line must wait for the table to retract to its lower position before such a box can be moved into position onto the table.

Other lid forming machines employ a ram which lowers the lid down onto the box. These machines suffer from the serious drawback of not obtaining good adhesion between the sides of the lid and the box. This is because there may be little or no lateral support for the sides of the box as the edges of the lid are pressed against it.

SUMMARY OF THE INVENTION

The present invention overcomes the aforementioned drawbacks of lid forming and adhesion machines, and provides additional benefits through an improved vertically oriented machine which is capable of forming and adhering lids to open ended fiberboard containers. The improved machine includes a lower horizontal conveyor for bringing open-ended containers into the machine; a vertical lifting section including a novel elevation mechanism for lifting the containers; a lid feeding mechanism located along the path of the vertical lifting section for providing the lids to be placed onto the containers; a series of adjustable angled spring-mounted compression shoes including a novel frictional lid holding member located along the path of the vertical lifting section above the lid feeding mechanism for deforming the sides of the lids around the container; and an ejection mechanism for removing the lidded container from the machine.

In operation, a filled box or tray approaches the infeed on a powered belt which provides an indexing function. As the box enters the machine, it moves onto the novel chain elevator mechanism. As the box is moved into position on the elevator, an adhesive is applied along two of the upper edges of the box. The elevator then lifts the box to the forming and adhesion station. As the filled box is moved onto the elevator and beginning to move upward, a lid blank is pulled from a side hopper and moved into position above the box. As the lid blank is moving into position, adhesive is applied to the underside of two of the flaps on the lid blank.

The vertical side walls of the filled box are perpendicular to the lid blank. The upward motion of the elevator brings these side walls into contact with the lid blank such that the box acts as a mandrel pushing the lid blank (now on top of the box) upward into the adjustable forming plows and compression shoes. These plows and shoes fold the outside flaps of the lid blank over the top of the box side walls, pressing them together. During such an operation, the side walls of the box may tend to bow or move from their vertical position, which can affect the adhesion of such walls to the lid flaps. In order to minimize such movement, the present invention includes a plurality of novel frictional members which press the top of the lid firmly against the vertical sidewalls as they move upward, thereby holding them in a vertical position. In addition, to the extent that slight movement of the side walls occurs, the pivotal spring mounting of the compression shoes allows them to conform to such movement, thereby assuring good adhesion.

The upward motion of the elevator pauses very briefly at this stage to allow the adhesive a moment to set. Meanwhile, another container box begins moving into position on the elevator below, and another lid begins to move above it. The compression shoes then retract and release the sealed box, and the elevator moves the box upward to a discharge area. At the same time, the elevator brings the next box up to begin the compression and sealing process again.

The novel elevator of the present invention allows subsequent boxes to continuously enter the machine rapidly, without waiting for a platform or other holder to be lowered to receive them. The novel frictional members assure good adhesion between the lid and the box by minimizing any bowing or other movement of the side walls from vertical during the adhesion process.

The lid forming machine of the present invention may be used to accomplish a variety of different actions related to the formation and/or adhesion of different kinds of lids to different container boxes. In one set of alternative embodiments, the machine may be modified and adjusted to facilitate formation and adhesion of lids having only two side flaps (instead of four) to the containers. Such embodiments would eliminate (deactivate) the use of one of the sets of adhesive applicators so that adhesive is only applied to the two parallel edges where there will be lid flaps. These embodiments would also eliminate the need for one of the sets of parallel deforming plows and shoes, since there would be no flaps on two of the parallel sides. This could be accomplished by simply moving the appropriate plows and shoes out and away from the vertical path of the container and lid. The determination of which set of adhesive applicators and which set of deforming plows and shoes to eliminate would depend upon which lid flaps are present and which have been eliminated. Those skilled in the art will appreciate that either set of parallel lid flaps can be eliminated, with machine adjustments being made accordingly.

In another set of embodiments, the machine may be modified and adjusted to facilitate formation and adhesion of lids having flaps which require multiple folds. The flaps on such lids ordinarily include two fold lines. For such lids, the plows and shoes could be set in a staggered relationship such that the outside edges are first folded along the outermost pre-scored (or perforated) lid fold line upon contact with an outer tier of staggered plows and shoes. Then as the lid is pushed upward, the inner edges make contact with an inner tier of plows and shoes resulting in a second fold along an inner pre-scored (or perforated) lid fold line. The action of the box against the first folded flap causes that flap to be secured under the second folded flap for a sturdy lid sidewall.

In another set of embodiments, the machine may be modified and adjusted to facilitate formation of lids which are not to be adhered directly to the container box. In many instances, it may be desirable for the lid not to be adhered to the box itself (e.g. the multiple-fold lids described in the previous embodiment). This would require elimination (deactivation) of the appropriate adhesive applicators either alone or in conjunction with adjustments to the shoes and plows.

It is therefore a primary object of the present invention to provide a compact machine capable of rapid formation of fiberboard lids for open-ended fiberboard containers, with or without adhesion of the lids to the containers.

It is another important object of the present invention to provide a vertically oriented lid forming machine that assures secure adhesion of lids to fiberboard containers.

It is another important object of the present invention to provide a fiberboard box elevator as part of a lid forming and adhesion machine which allows a subsequent box to enter the machine to begin processing before processing of the preceding box has been completed.

It is another important object of the present invention to provide a vertically oriented lid forming machine that utilizes a plurality of frictional members which engage the top of the lid and press it down against the container in order to minimize sliding and bowing of the container side walls as the lid flaps are adhered thereto.

It is another important object of the present invention to provide a vertically oriented lid forming machine that utilizes a plurality of retractable adjustable pivotally mounted spring-loaded compression shoes which are capable of conforming to slight movements of the container side walls as the lid flaps are adhered thereto.

It is also an important object of the present invention to provide a vertically oriented lid forming machine in which the lid hopper can be replenished during operation without interrupting the processing of the machine.

It is another important object of the present invention to provide a vertically oriented machine for forming lids for fiberboard containers without adhering such lids to such containers.

It is another important object of the present invention to provide a vertically oriented machine for forming multiple fold lids for fiberboard containers.

Additional objects of the invention will be apparent from the detailed descriptions and the claims herein.

DETAILED DESCRIPTION OF THE DRAWINGS

Figure 2:
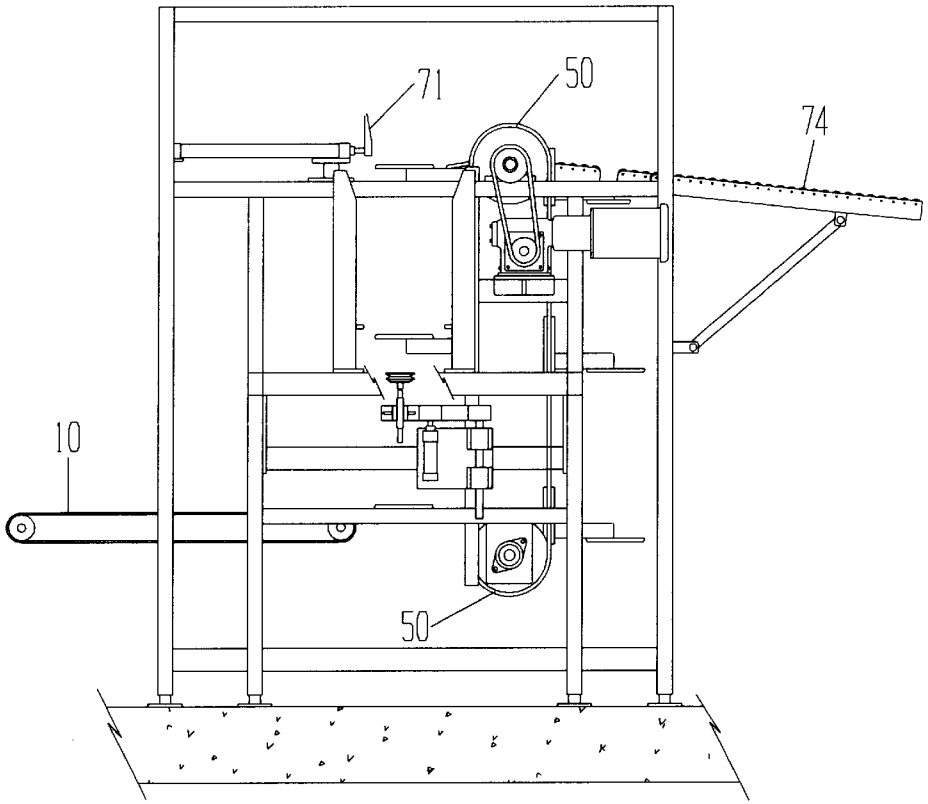
FIG. 2 is a partially cut-away side elevational view of the invention shown in FIG. 1.
Figure 1:
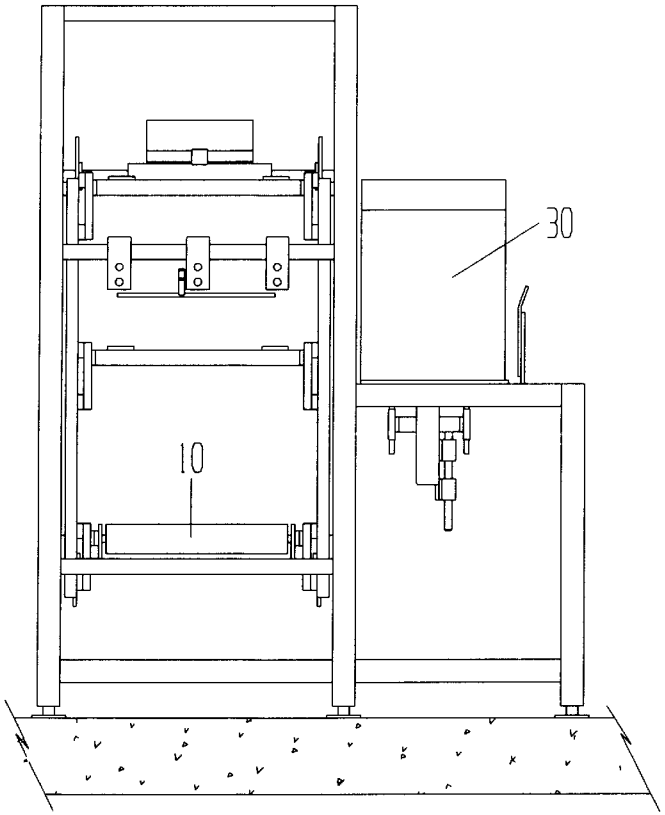
FIG. 1 is an elevational end view of the machine of the present invention.

Referring to the drawings wherein like reference characters designate like or corresponding parts throughout the several views, and referring generally to FIGS. 1 and 2 it is seen that the operative portion of the invention includes an input conveyor 10, an elevator mechanism 50, a horizontal lid feeder 30, a discharge ram 71 and a discharge ramp 74.

Figure 3A:
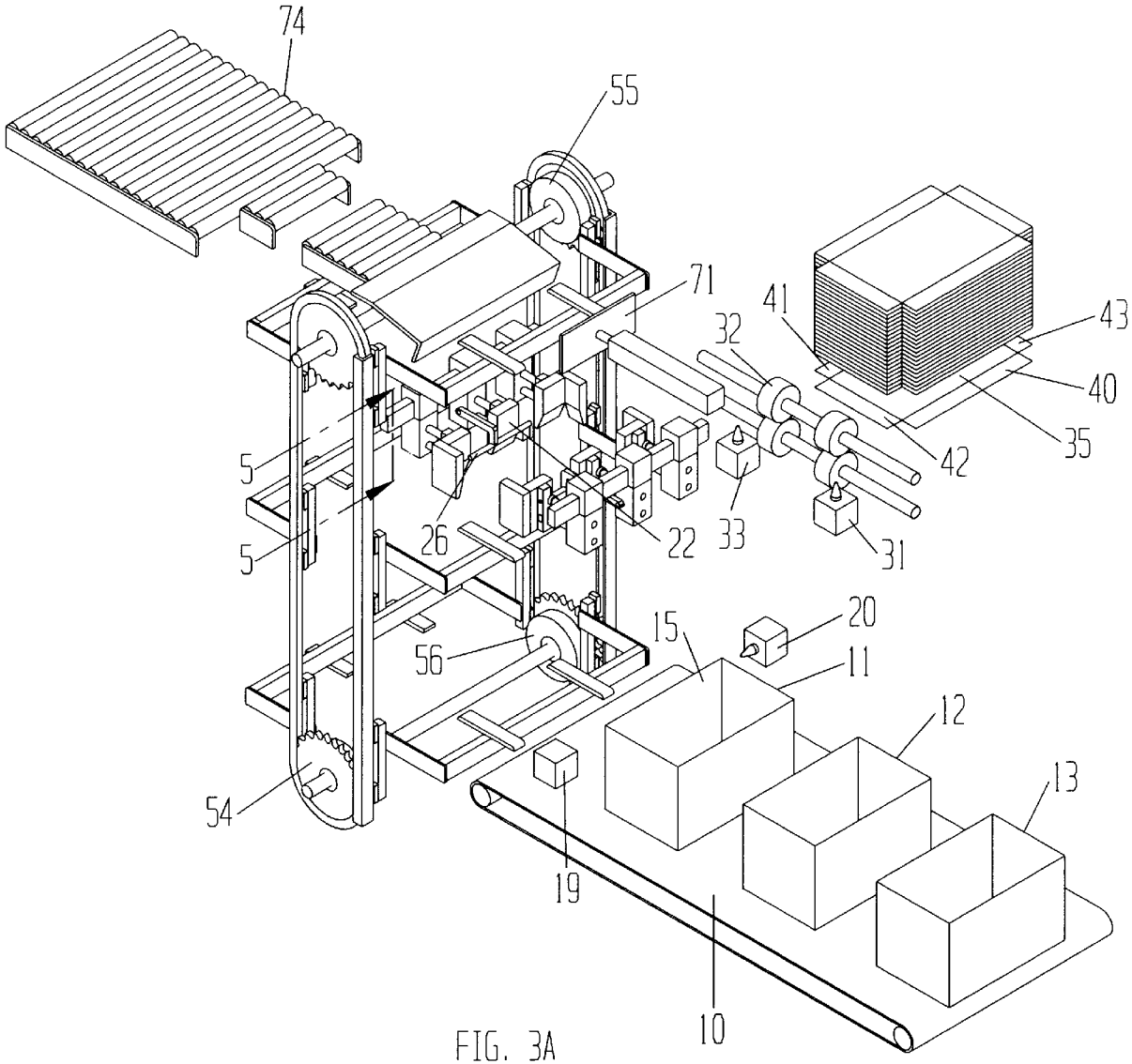
FIG. 3A is a perspective view of the operational parts of the machine before entry of a container box or lid.
Figure 3B:
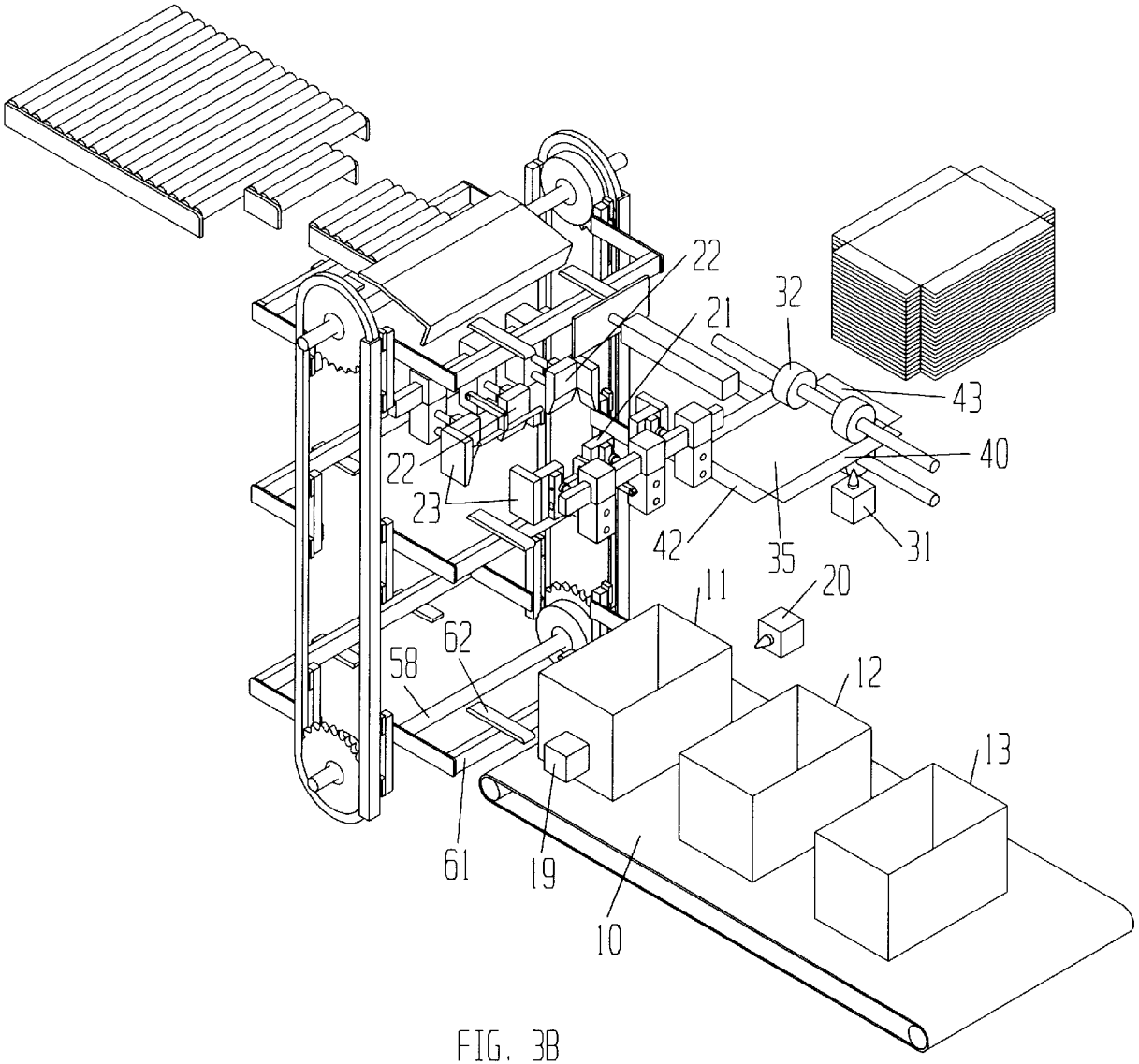
FIG. 3B is a view from the same perspective view as FIG. 3A showing the movement of a box and a lid into the machine.
Figure 6:
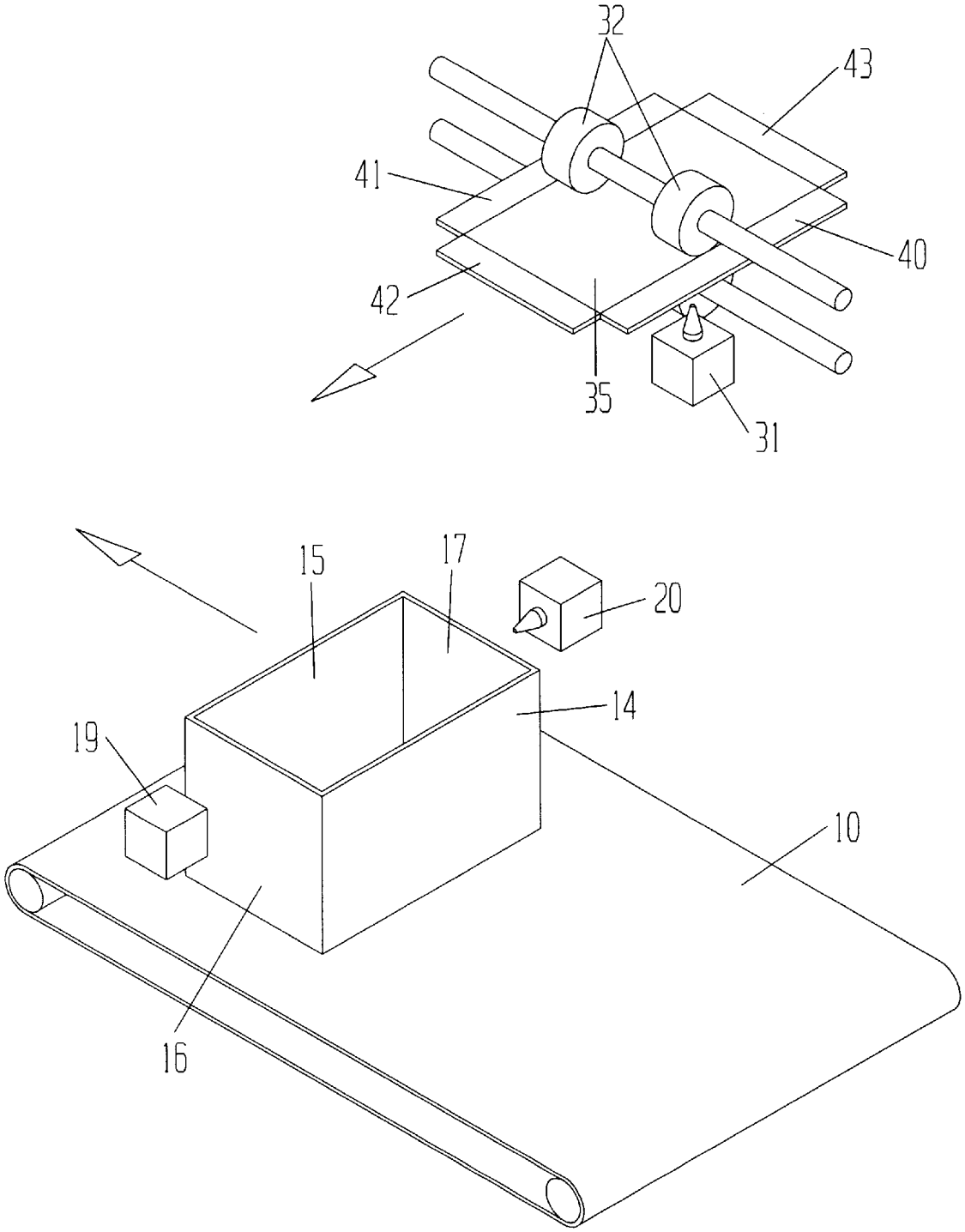
FIG. 6 is an enlarged perspective view of the adhesive applicators of the present invention.

Referring more particularly to FIGS. 3A, 3B and 6, it is seen that open-ended boxes 11, 12 and 13 are moved into the machine using conveyor 10. Each box (e.g. 11) has two parallel side walls 14 and 15, that are perpendicular to two other parallel side walls 16 and 17. As box 11 exits conveyor 10 and enters the machine, it passes between al pair of adjustable electronically controlled adhesive applicators 19 and 20 which spray adhesive along the upper edges of the two parallel side walls 16 and 17 (see FIG. 6).

At or about the same time, the lowermost lid blank 35 is removed via suction or other appropriate means (not shown) from the bottom of a side hopper 30. Each lid blank has two parallel deformable flaps 40 and 41 that are perpendicular to two other parallel deformable flaps 42 and 43. A plurality of rollers 32 move the lid blank 35 into place along the elevator path below the compression shoes 21–24. As this takes place, adjustable adhesive applicators 31 and 33 spray adhesive onto the bottoms of flaps 40 and 41 of blank 35.

Figure 3C:
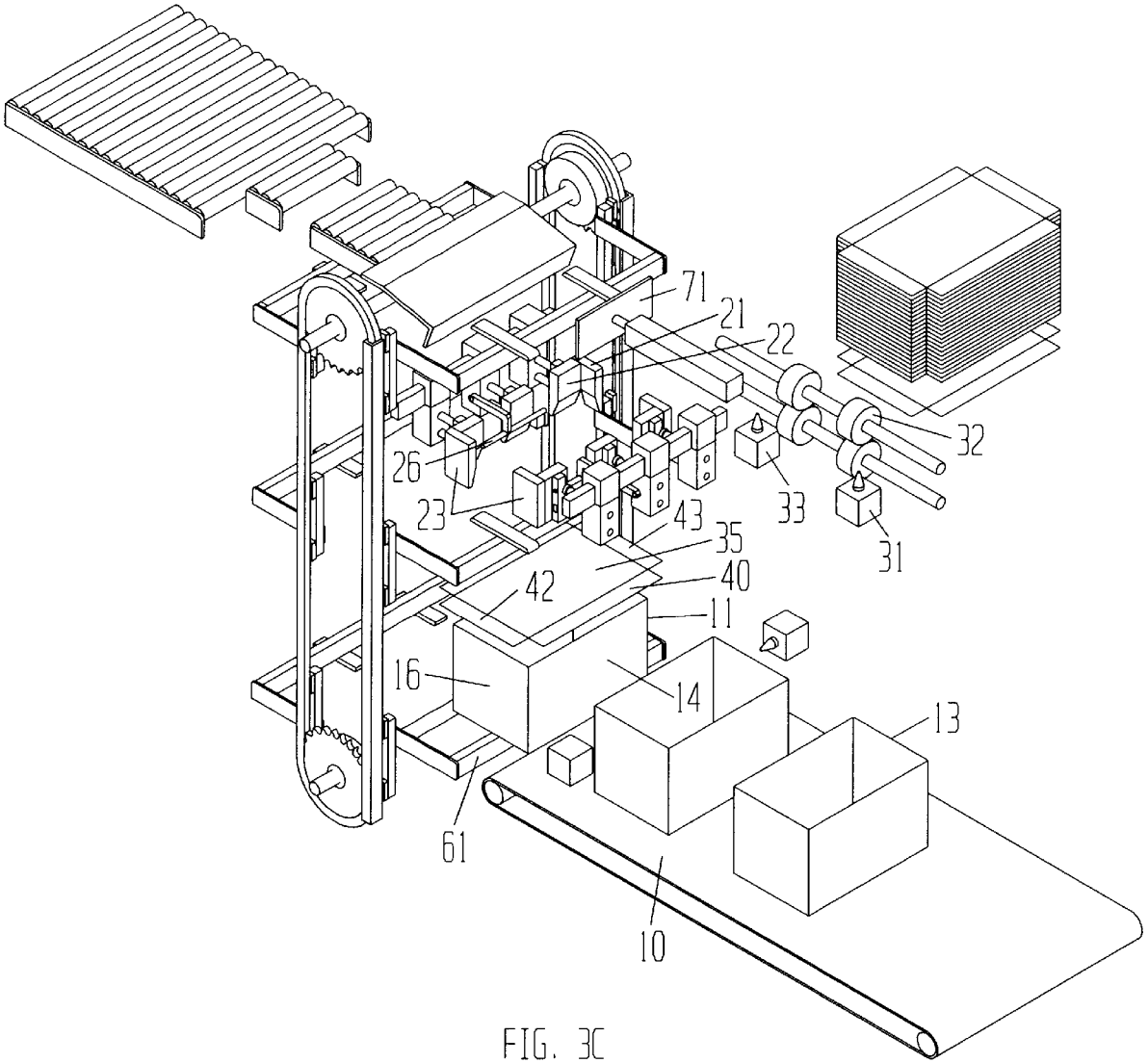
FIG. 3C is a view from the same perspective view as FIG. 3B showing the box on the elevator of the machine with the lid in position above it.
Figure 4:
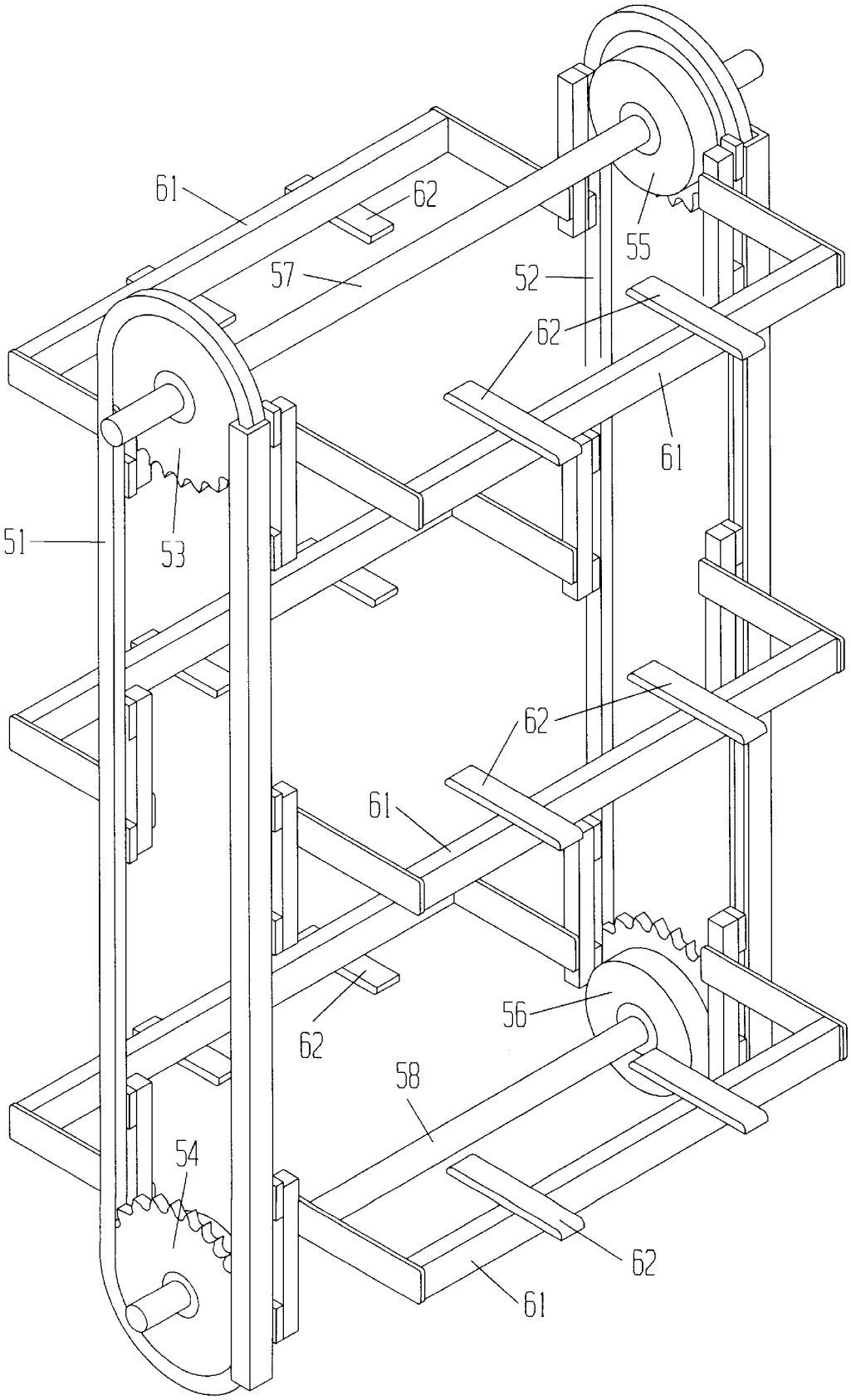
FIG. 4 is an enlarged perspective view of the elevator of the present invention.

FIG. 3C shows box 11 in place on elevator 50 with lid blank 35 above it As shown in FIG. 4, elevator 50 includes a pair of parallel continuous belts or chains 51 and 52. Each belt is mounted around a pair of upper and lower sprockets 53 & 54, and 55 & 56, respectively. Upper sprockets 53 and 55 are attached to an electronically controlled upper rotatable bar 57; similarly, lower sprockets 55 and 56 are attached to lower rotatable bar 58 which is under the same electronic control.

A plurality of lifting flights 61 are attached at regular intervals along belts 51 and 52. Each flight 61 includes a plurality of support plates or cleats 62 for holding the boxes. Belts 51 and 52 move flights 61 in an upward direction on the compression side of the elevator, and in a downward direction on the outside, such, that flights 61 are constantly rotating around the elevator. At any given time, elevator 50 is capable of holding three separate boxes at lower, middle, and upper locations (see FIG. 3E).

Figure 3D:
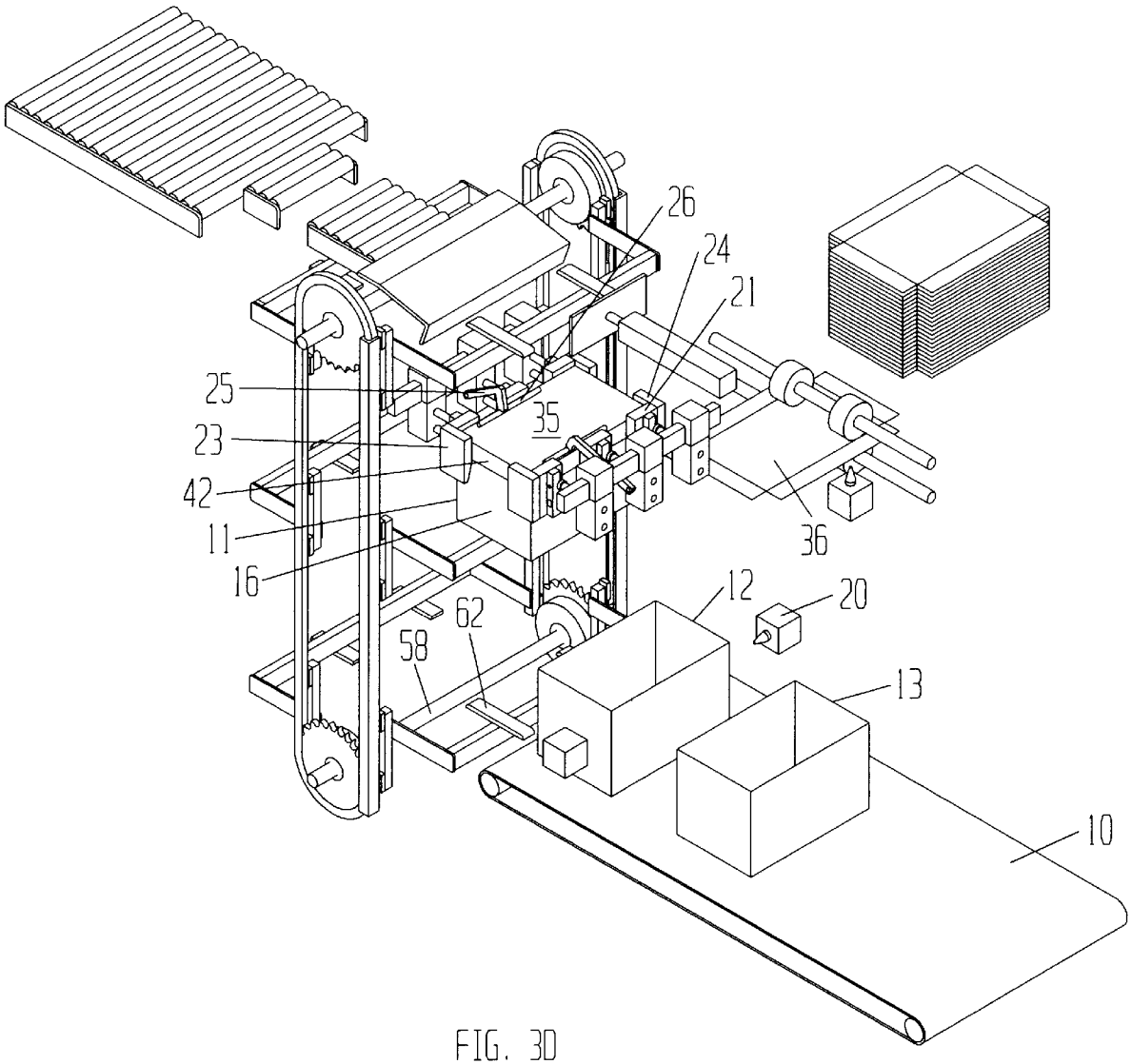
FIG. 3D is a view from the same perspective view as FIG. 3C showing the box and lid being lifted by the elevator into the compression section of the machine. A subsequent box and subsequent lid have begun to move into the machine.
Figure 3E:
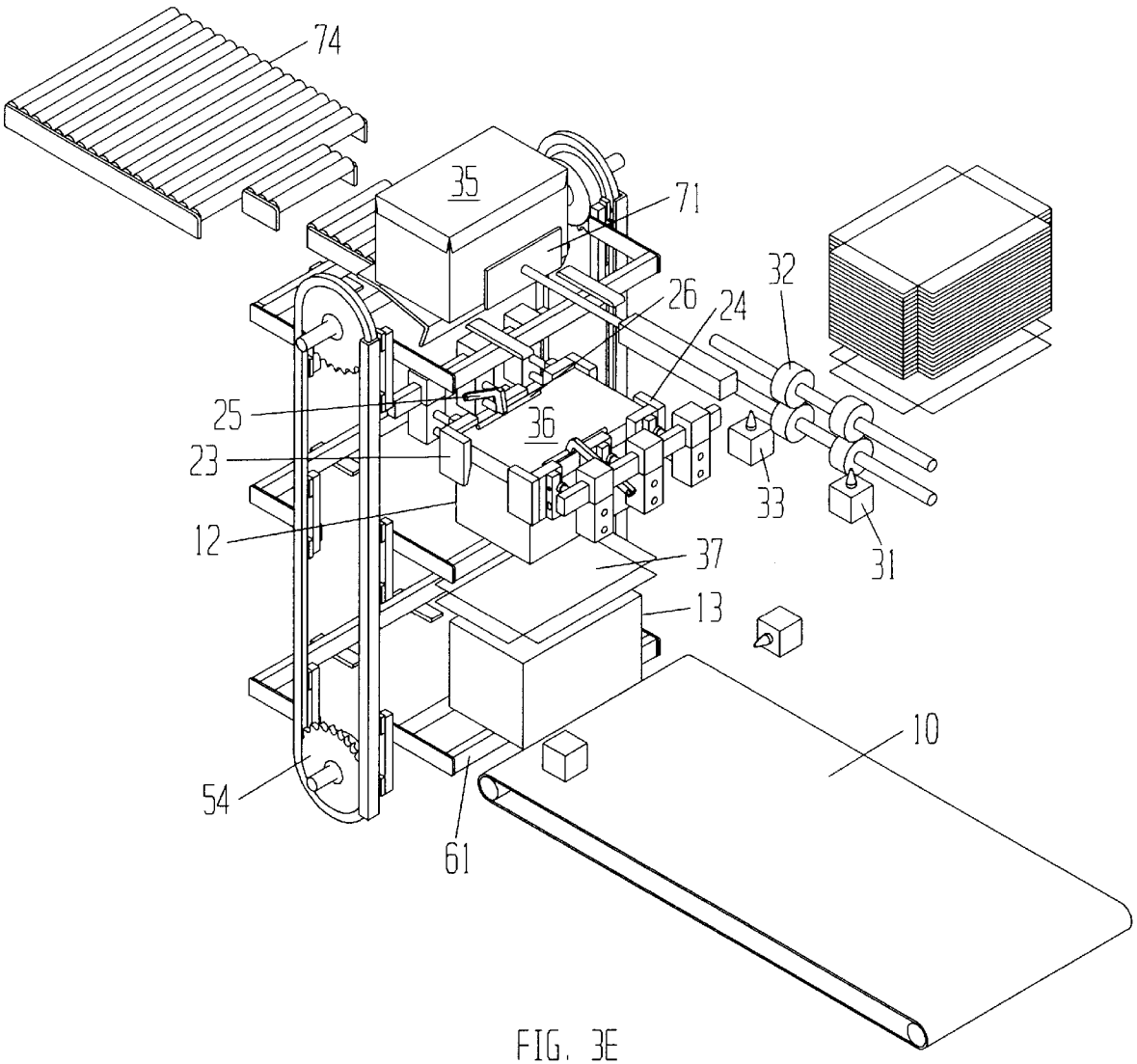
FIG. 3E is a view from the same perspective view as FIG. 3D showing the box with the lid adhered thereto being removed from the top of the elevator. The subsequent box and lid have moved into the compression section of the machine, and another box and lid have begun to move into the machine.

The lifting operation of elevator 50 is shown in FIGS. 3C–3E. In FIG. 3C, box 11 has been moved to the lower location of the elevator. Lowermost lid blank 35 has been removed from the stack and moved directly above box 11 by electronically controlled rollers 32. The elevator flight 61 with support plates 62 moves box 11 upward such that it comes into contact with lid blank 35 and pushes it upward into the adjustable compression shoes 21–24. This is shown in FIG. 3D. Shoes 21–24 compress lid flaps 40–43 against box sidewalls 14–17, respectively. After a very brief pause to allow the adhesive to bind, elevator 50 continues to move box 11 upward with lid 35 now firmly adhered thereto. This upward motion by the elevator also brings a flight 61 into contact with the next box 12 moving it up toward its lid 36 as the process repeats (see FIG. 3E). At the top of the elevator, hydraulic ram 71 moves closed box 11 down discharge ramp 74 for removal and transport.

Detail of the compression shoes is shown in FIGS. 5A–5F. These figures illustrate only the cross sectional view of compression shoe 22; however, the same structure is present for shoes 21, 23 and 24. Shoe 22 includes an angled deflection surface and is attached to a retractable member 38 using a pair of spring biased mounting members 28 and 34. These springs urge shoe 22 to extend inward, thereby allowing it to yieldably press against box wall 15 and lid flap 41. Since there are two springs, shoe 22 is able to pivot slightly from vertical in order to conform to potential non-vertical positions of either the lid flap 41 (see FIG. 5D) or the side wall 15. An L-shaped frictional member 25 is also provided, and is pivotally mounted to the frame at one end 29. A biasing spring 27 urges member 25 downward. An elongated bar 26 is attached at the opposite end of member 25.

Figure 5A:
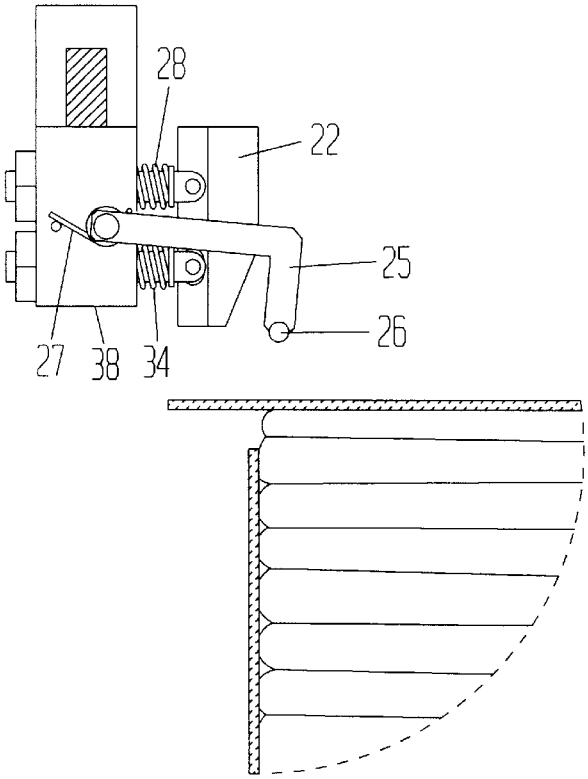
FIG. 5A is an enlarged partially cut away side view along line 5—5 of FIG. 3A showing detail of a compression shoe and the pivotal frictional member. A box and lid are below them.
Figure 5B:
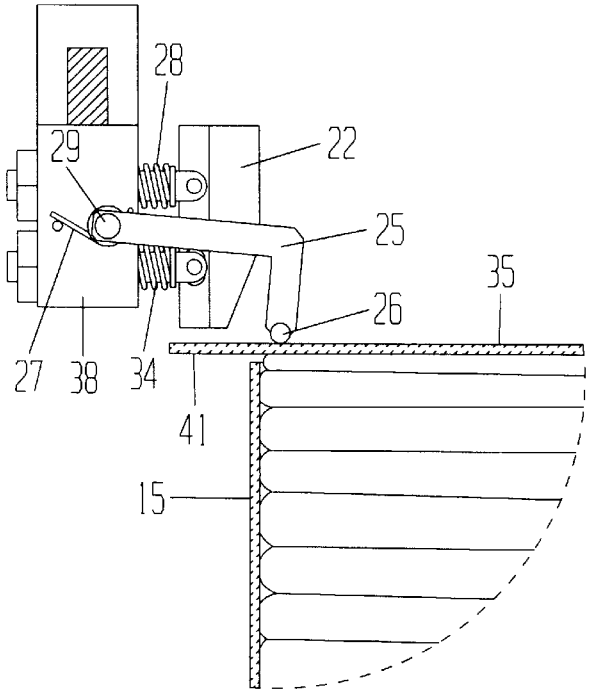
FIG. 5B is a view from the same perspective view as FIG. 5A showing the frictional member in contact with the top of the upwardly moving lid.
Figure 5C:
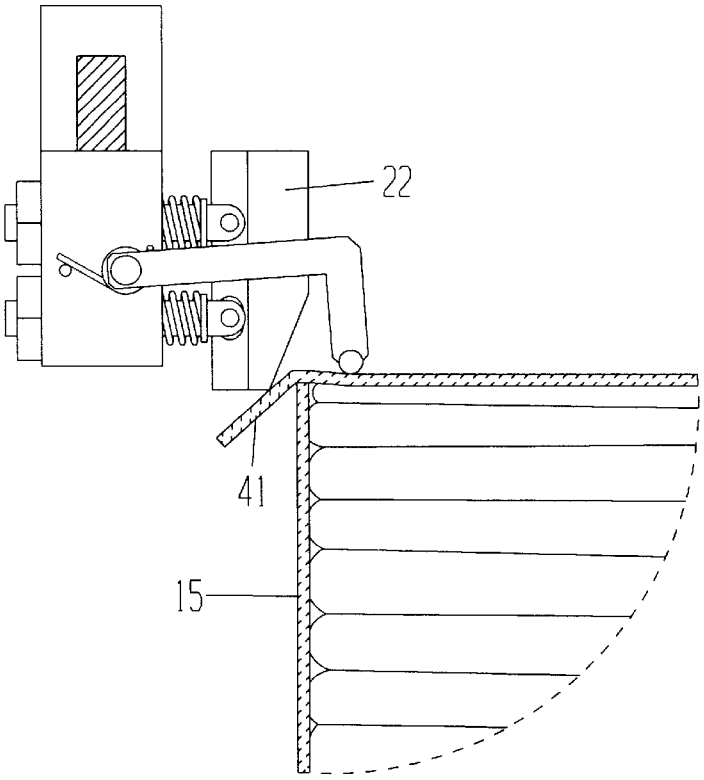
FIG. 5C is a view from the same perspective view as FIG. 5B showing the frictional member in contact with the top of the lid, and the lid flap being partially deformed by the compression shoe as it moves upward.
Figure 5D:
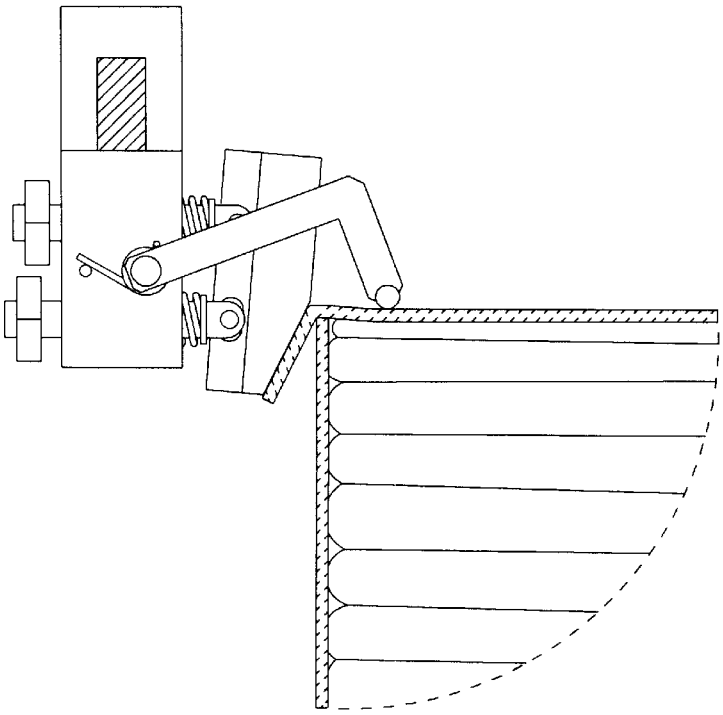
FIG. 5D is a view from the same perspective view as FIG. 5C showing the frictional member in contact with the top of the lid, and the lid flap being more fully deformed by the pivoting compression shoe as the box moves upward.
Figure 5E:
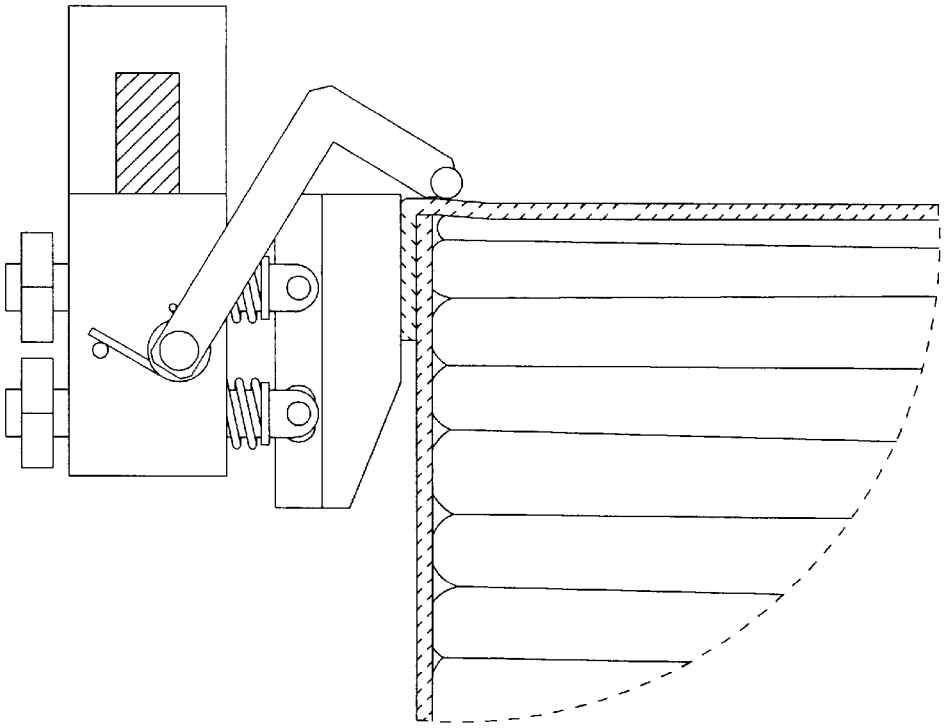
FIG. 5E is a view from the same perspective view as FIG. 5D showing the frictional member in contact with the top of the lid, and the lid flap being completely deformed and pressed against the side wall of the box by the compression shoe as the box moves upward.
Figure 5F:
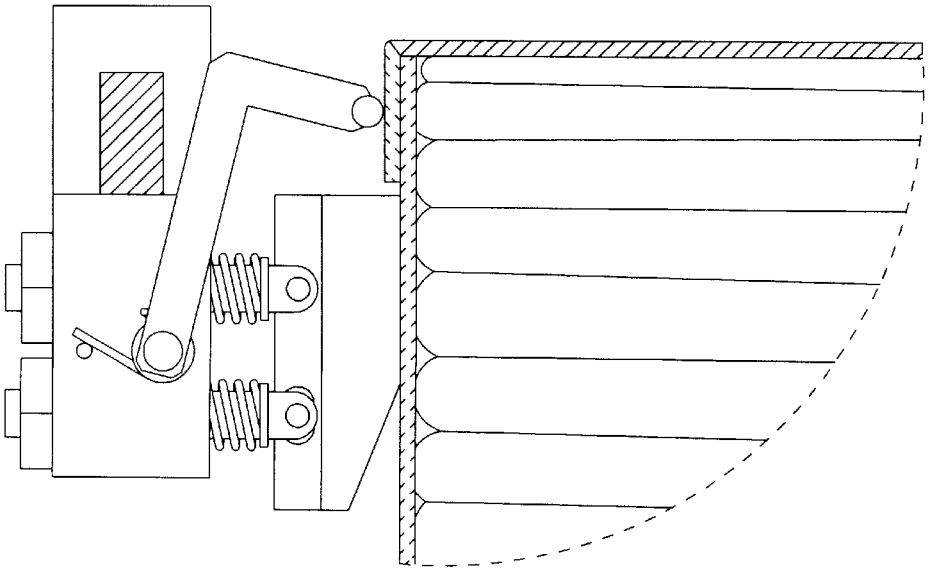
FIG. 5F is a view from the same perspective view as FIG. 5E showing the frictional member now in contact with the deformed side flap of the lid, the lid flap being adhered against the side wall of the box, and the compression shoe against the box sidewall as the box moves upward.

As box wall 14 and lid flap 41 are moved upward, bar 26 first comes into contact with the top of lid 35 (see FIG. 5B). The downward friction imparted by bar 26 holds lid 35 firmly against perpendicular wall 15 of box 11. This pressure minimizes slippage of wall 15 out of vertical alignment. As it moves upward, flap 41 then encounters angled shoe 22, and is deformed downward as shown in FIGS. 5C and 5D. The pressure from bar 26 continues to hold lid 35 firmly against wall 15 so that it does not deviate from vertical alignment. Maintaining wall 15 in vertical alignment is important as shown in FIG. 5E when flap 41 is pressed firmly against wall 15 for adhesion. There is then a brief pause for binding. Then, once the adhesion is complete bar 26 rolls off the top of the lid as shown in FIG. 5F.

The positions of shoes 21–24, and the positions of adhesive applicators 19, 20, 31 and 33 may be may be adjusted over a wide range of positions thereby allowing the machine to be used with boxes and lids having many different sizes and shapes.

In an alternative embodiment, the machine may be modified and adjusted to facilitate formation and adhesion of lids 35 having only two side flaps (instead of four). If flaps 40 and 41 are present, then adhesive sprayers 31 and 33 would be used, but sprayers 19 and 20 would not be needed; and shoes 21 and 22 would be used, but shoes 23 and 24 would not be needed. Alternatively, if flaps 42 and 43 are present, then adhesive sprayers 19 and 20 would be used, but sprayers 31 and 33 would not be needed; and shoes 23 and 24 would be used, but shoes 21 and 22 would not be needed.

In another embodiment, the machine may be modified and adjusted to facilitate formation and adhesion of lids having flaps which require multiple folds. For a lid with two flap fold lines, an additional set of compression shoes could be placed in a staggered relationship below shoes 21–24 such that the outside flaps of the lid are first folded along the outermost lid fold line upon contact with said additional shoes. Then as the lid is pushed upward, the inside flaps would make contact with shoes 21–24 resulting in a second fold along the inner lid fold line. The action of the box side walls 14–17 against the first folded flap would cause that flap to be secured under the second folded flap for a sturdy lid sidewall. The adhesive applicators 31 and 33 could be positioned to spray adhesive only on the lid flap with two fold lines, resulting in good adhesion of the double fold, but no adhesion of the lid to the box.

DESCRIPTION OF THE PREFERRED EMBODIMENTS

In the preferred embodiment, belts 51 and 52 of elevator 50 are metal chains, and flights 61 include at least two cleats 62 for support of the container boxes. Hopper 30 should be open at the top in order to allow additional lid blanks 35 to be inserted during operation of the machine without interruption. Vacuum suction may be used to remove the lowermost lid blank from the bottom of the stack in hopper 30, although gravity and a slidable pick may suffice. Electronic controls should be employed to facilitate continuous and coordinated operation of input conveyor 10, elevator 50, sprayers 19–20 and 31,33, lid rollers 32, compression shoes 21–24, and ram 71.

The positions of shoes 21–24 should be adjustable over a wide range (horizontally, vertically and rotationally), in order to facilitate receiving any of a variety of boxes having different sizes and shapes. Similarly, the positions of the adhesive applicators should be adjustable over a wide range to allow adhesive to be applied to any appropriate location on a box or lid blank.

In an alternative embodiment, a second parallel elevator may be employed immediately adjacent to the existing elevator 50 in order to lift extremely heavy boxes.

In another alternative embodiment, additional compression shoes may be added to facilitate deforming multiple-fold lid flaps.

In another alternative embodiment, additional adhesive applicators may be added to facilitate application of adhesive to multiple locations on a box or lid blank.

In use, the dimensions and style of the container and lid must first be selected. Then, the positions of the adhesive applicators, lifting flights, and compression shoes must be adjusted for receiving the boxes and lids.

It is to be understood that variations and modifications of the present invention may be made without departing from the scope thereof. It is also to be understood that the present invention is not: to be limited by the specific embodiments disclosed herein, but only in accordance with the appended claims when read in light of the foregoing specification.

What is claimed is:

1. A machine for forming and attaching lids to containers comprising:

a. a lower horizontal conveyor for bringing open-ended containers with side walls into the machine;

b. a first plurality of adhesive applicators located at one end of said conveyor for applying adhesive to certain side walls of the containers;

c. a lift at the end of said conveyor adjacent to said applicators for continuously receiving and raising the containers in a vertical direction inside the machine without lowering between containers, said lift comprising a pair of continuous belts mounted on parallel sprockets and having a plurality of cross members attached thereto at regular intervals, each such cross member including a plurality of support members for holding said containers;

d. a feed located along the path of said lift for providing lid blanks with flaps above said containers;

e. a second plurality of adhesive applicators located along the path of said feed for applying adhesive to certain flaps of said lid blanks;

f. a plurality of adjustable angled compression shoes located along the path of said lift above said feed for deforming the flaps of said lid blanks around the container; and g. an ejection ram for removing the lidded container from the machine.

2. The machine described in claim 1 wherein a pivotally mounted spring-loaded frictional member is provided above each compression shoe for pressing the top of each lid blank against the adjacent side wall of a container.

3. The machine described in claim 2 wherein said compression shoes are mounted using at least two springs to allow pivotal movement of said shoes as they are pressed against the lid flaps and container side walls moving by.

4. In a machine for forming lids for open-ended fiberboard containers, an apparatus comprising:

a. a lower horizontal conveyor for bringing open-ended containers with side walls into the machine;

b. a first plurality of adhesive applicators located at one end of said conveyor for applying adhesive to certain side walls of the containers;

c. a lift at the end of said conveyor adjacent to said applicators for continuously receiving and raising the containers in a vertical direction inside the machine without lowering between containers, said lift comprising a pair of continuous belts mounted on parallel sprockets and having a plurality of cross members attached thereto at regular intervals, each such cross member including a plurality of support members for holding said containers;

d. a feed located along the path of said lift for providing lid blanks with flaps above said containers;

e. a second plurality of adhesive applicators located along the path of said feed for applying adhesive to certain flaps of said lid blanks;

f. a plurality of adjustable angled compression shoes located along the path of said lift above said feed for deforming the flaps of said lid blanks around the container; and g. an ejection ram for removing the lidded container from the machine.

5. The machine described in claim 4 wherein a pivotally mounted spring-loaded frictional member is provided above each compression shoe for pressing the top of each lid blank against the adjacent side wall of a container.

6. The machine described in claim 5 wherein said compression shoes are mounted using at least two springs to allow pivotal movement of said shoes as they are pressed against the lid flaps and container side walls moving by.

7. A method for forming lids for fiberboard containers comprising the steps of:

a. placing an open-ended container with side walls onto a lower horizontal conveyor;

b. moving said open-ended container past a first plurality of adhesive applicators located at one end of said conveyor;

c. applying adhesive to certain side walls of the container;

d. lifting said container in a vertical direction inside the machine without lowering between containers using a lift comprising a pair of continuous belts mounted on parallel sprockets and having a plurality of cross members attached thereto at regular intervals, each such cross member including a plurality of support members for holding said containers, d. feeding a lid blank with flaps into a position above said container;

e. applying adhesive to certain flaps of said lid blank;

f. lifting said container so that it comes into contact with said lid blank;

g. deforming the flaps of said lid blank around the container by lifting said container and blank into a plurality of adjustable angled compression shoes provided along the path of said lift above said feed, each such compression shoe being mounted using at least two springs to allow pivotal movement of said shoes as they are pressed against the lid flaps and side walls of the containers moving by; and g. ejecting said lidded container from the machine.

8. A machine for forming and attaching lids to containers comprising:

a. a lower horizontal conveyor for bringing open-ended containers with side walls into the machine;

b. a first plurality of adhesive applicators located at one end of said conveyor for applying adhesive to certain side walls of the containers;

c. a lift at the end of said conveyor adjacent to said applicators for raising the containers in a vertical direction inside the machine, said lift comprising a pair of continuous belts mounted on parallel sprockets and having a plurality of cross members attached thereto at regular intervals, each such cross member including a plurality of support members for holding said containers;

d. a feed located along the path of said lift for providing lid blanks with flaps above said containers;

e. a second plurality of adhesive applicators located along the path of said feed for applying adhesive to certain flaps of said lid blanks;

f. a plurality of adjustable angled compression shoes located along the path of said lift above said feed for deforming the flaps of said lid blanks around the container each such compression shoe being mounted using at least two springs to allow pivotal movement of said shoes as they are pressed against the lid flaps and container side walls moving by;

g. a plurality of pivotally mounted spring-loaded frictional members provided above each compression shoe for pressing the top of each lid blank against the adjacent side wall of a container; and h. an ejection ram for removing the lidded container from the machine.

9. In a machine for forming lids for open-ended fiberboard containers, an apparatus comprising:

a. a lower horizontal conveyor for bringing open-ended containers with side walls into the machine;

b. a first plurality of adhesive applicators located at one end of said conveyor for applying adhesive to certain side walls of the containers, c. a lift at the end of said conveyor adjacent to said applicators for raising the containers in a vertical direction inside the machine, said lift comprising a pair of continuous belts mounted on parallel sprockets and having a plurality of cross members attached thereto at regular intervals, each such cross member including a plurality of support members for holding said containers;

d. a feed located along the path of said lift for providing lid blanks with flaps above said containers;

e. a second plurality of adhesive applicators located along the path of said feed for applying adhesive to certain flaps of said lid blanks;

f. a plurality of adjustable angled compression shoes located along the path of said lift above said feed for deforming the flaps of said lid blanks around the container each such compression shoe being mounted using at least two springs to allow pivotal movement of said shoes as they are pressed against the lid flaps and container side walls moving by;

g. a plurality of pivotally mounted spring-loaded frictional members provided above each compression shoe for pressing the top of each lid blank against the adjacent side wall of a container; and h. an ejection ram for removing the lidded container from the machine.

* * * * *